US009909822B2

(12) United States Patent
Rusich et al.

(10) Patent No.: US 9,909,822 B2
(45) Date of Patent: Mar. 6, 2018

(54) CHANNEL GUIDE DISTRIBUTOR

(71) Applicant: Hamilton Sundstrand Corporation, Windsor Locks, CT (US)

(72) Inventors: Richard Rusich, Ellington, CT (US); Theodore C. Wright, Montgomery, MA (US); James N. Streeter, Torrington, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 200 days.

(21) Appl. No.: 15/018,336

(22) Filed: Feb. 8, 2016

(65) Prior Publication Data

US 2017/0227303 A1 Aug. 10, 2017

(51) Int. Cl.

| | |
|---|---|
| ***F28F 9/02*** | (2006.01) |
| ***F25B 39/00*** | (2006.01) |
| *F25B 39/02* | (2006.01) |

(52) U.S. Cl.

CPC ..... *F28F 9/0273* (2013.01); *F25B 39/00* (2013.01); *F25B 39/028* (2013.01)

(58) Field of Classification Search

CPC ..... F28F 9/0273; F25B 39/00; F25B 39/028

USPC ..... 261/97, 110

See application file for complete search history.

(56) References Cited

U.S. PATENT DOCUMENTS

| | | | | |
|---|---|---|---|---|
| 3,895,676 | A * | 7/1975 | Young | F25B 39/02 165/167 |
| 8,607,852 | B2 * | 12/2013 | Stromer | F28D 9/005 165/174 |
| 2008/0093051 | A1 * | 4/2008 | Rios | F25B 41/067 165/61 |
| 2012/0061064 | A1 * | 3/2012 | Stromer | F28D 9/005 165/177 |
| 2013/0340984 | A1 * | 12/2013 | Alahyari | F25B 39/028 165/139 |
| 2014/0345837 | A1 * | 11/2014 | Alahyari | F28F 1/40 165/169 |
| 2015/0168081 | A1 * | 6/2015 | Ito | F28F 3/08 165/166 |
| 2015/0377566 | A1 * | 12/2015 | Huazhao | F25B 39/028 165/177 |
| 2016/0025420 | A1 * | 1/2016 | O' Coin | F28D 15/02 165/104.21 |

(Continued)

FOREIGN PATENT DOCUMENTS

EP 2806244 A1 * 11/2014

*Primary Examiner* — Charles Bushey
*Assistant Examiner* — Scott Bushey
(74) *Attorney, Agent, or Firm* — Cantor Colburn LLP

(57) ABSTRACT

A channel guide distributor of a heat exchanger including a flanged body, a nozzle fluidly connected to the flanged body, a diffuser fluidly connected to the nozzle, a pin operably connected to the nozzle, a cone operably connected to the nozzle and a post removably connected to the flanged body and configured to receive the diffuser. The post having a tubular portion, an open end, a closed end, an inner surface, an outer surface, a post longitudinal axis, and twenty-four apertures in the tubular portion. The apertures are aligned linearly along the post longitudinal axis and equidistantly spaced. A diameter of the outer surface of the tubular portion is about 1.156±0.003 inches (2.936±0.01 centimeters).

20 Claims, 6 Drawing Sheets

(56) References Cited

U.S. PATENT DOCUMENTS

2016/0273847 A1* 9/2016 Rusich ..... F28F 9/24

* cited by examiner

CHANNEL GUIDE DISTRIBUTOR

BACKGROUND OF THE INVENTION

The subject matter disclosed herein generally relates to heat exchanger arrangements, and more particularly to a heat exchanger distribution assembly.

Distribution of two-phase fluid flow (liquid and gas) inside heat exchangers poses several challenging issues. In heat exchangers, such as mini-channel, micro-channel, plate-fin, and brazed-plate heat exchangers, for example, distribution is particularly difficult due to the requirement that the flow must be distributed among many layers and small ports. To overcome the challenges, these types of heat exchangers may employ a piccolo distributor having a closed-end tube with a series of holes in the side. The assumption behind this approach is that the flow entering the distributor is annular or well-mixed and remains that way through the distributor tube. However, the cavity within the distributor may not be able to avert separation of the two-phase fluid under different operating conditions. The flow may tend to stratify due to deceleration in the distributor and as a result, liquid pools at the end of the tube while vapor leaves through early ports. Therefore, the mass fraction provided to each fin passage is not properly apportioned and may yield poor system performance.

BRIEF DESCRIPTION OF THE INVENTION

According to an embodiment of the present disclosure, a channel guide distributor of a heat exchanger including a flanged body, a nozzle fluidly connected to the flanged body, a diffuser fluidly connected to the nozzle, a pin operably connected to the nozzle, a cone operably connected to the nozzle and a post removably connected to the flanged body and configured to receive the diffuser. The post having a tubular portion, an open end, a closed end, an inner surface, an outer surface, a post longitudinal axis, and twenty-four apertures in the tubular portion. The apertures are aligned linearly along the post longitudinal axis and equidistantly spaced. A diameter of the outer surface of the tubular portion is about 1.156±0.003 inches (2.936±0.01 centimeters).

According to another embodiment of the present disclosure, a channel guide distributor of a heat exchanger including a flanged body having an inlet, an outlet, an interior surface, an exterior surface, a first section proximate the inlet, a second section proximate the outlet, a flange between the first section and the second section, a flange longitudinal axis, and an orifice connecting the outlet to the inlet. The exterior surface of the flanged body at the second section has a diameter of 1.1735±0.0005 inches (2.9807±0.0013 centimeters). The flange has a first surface proximate to the first section and a second surface proximate to the second section. The orifice has a diameter of about 0.500 inches (1.270 centimeters). A distance between the second surface of the flange and the inlet is about 0.960±0.005 inches (2.438±0.01 centimeters), as measured along the flange longitudinal axis. The channel guide distributor also includes, a nozzle fluidly connected to the flanged body, a diffuser fluidly connected to the nozzle, a pin operably connected to the nozzle, a cone operably connected to the nozzle, and a post removably connected to the flanged body and configured to receive the diffuser.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
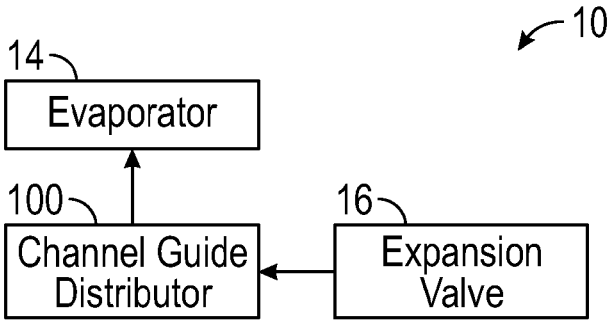
FIG. 1 is a schematic diagram of a heat exchanger subsystem.

Referring to FIG. 1, a schematic diagram of a heat exchanger subsystem 10 is schematically illustrated. The heat exchanger subsystem 10 may be used in conjunction with an assembly or system of a vehicle, such as an aircraft; however, it is contemplated that other vehicles or applications may benefit from the embodiments described herein. In certain embodiments, the heat exchanger subsystem 10 is employed in an aircraft air conditioning system or refrigeration unit. The heat exchanger subsystem 10 includes an expansion valve assembly 16 configured to reduce pressure from a refrigerant to allow expansion or change of state from a liquid to a vapor, thereby resulting in a fluid comprising a two-phase flow. The fluid is supplied to a channel guide distributor 100. As shown, the heat exchanger subsystem is illustrated with an evaporator 14. It is contemplated that the embodiments of the channel guide distributor 100 may be used in conjunction with various types of evaporators 14, such as those having a construction referred to as micro-channel, mini-channel, plate-fin, and brazed plate.

Figure 2:
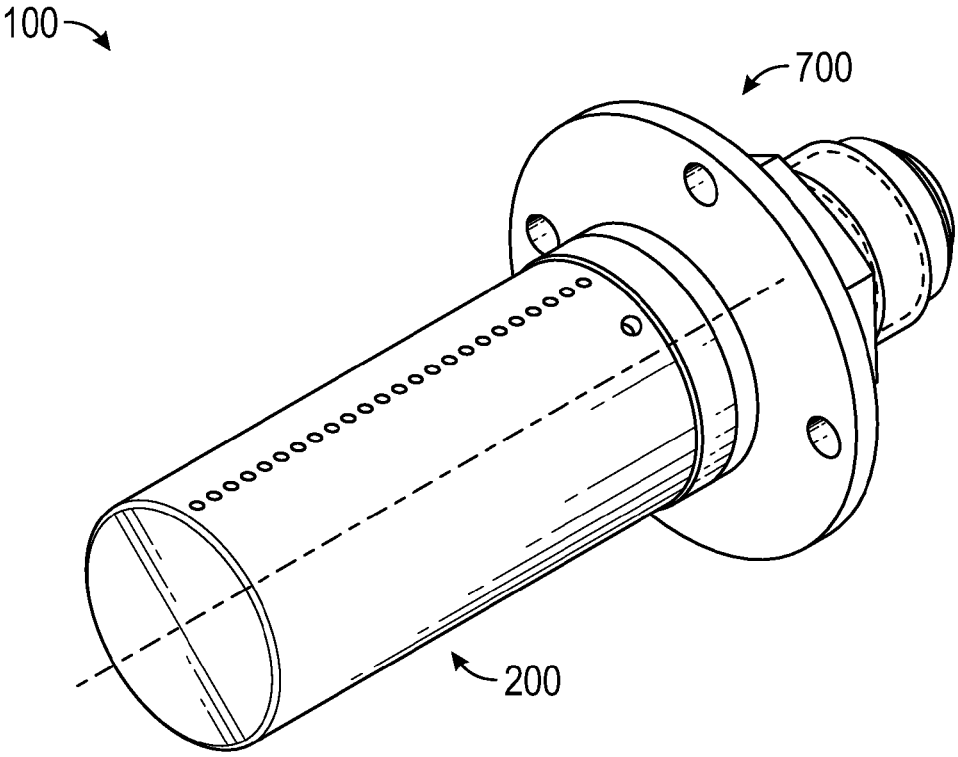
FIG. 2 is an isometric view of a channel guide distributor, according to an embodiment of the present disclosure.
Figure 3:
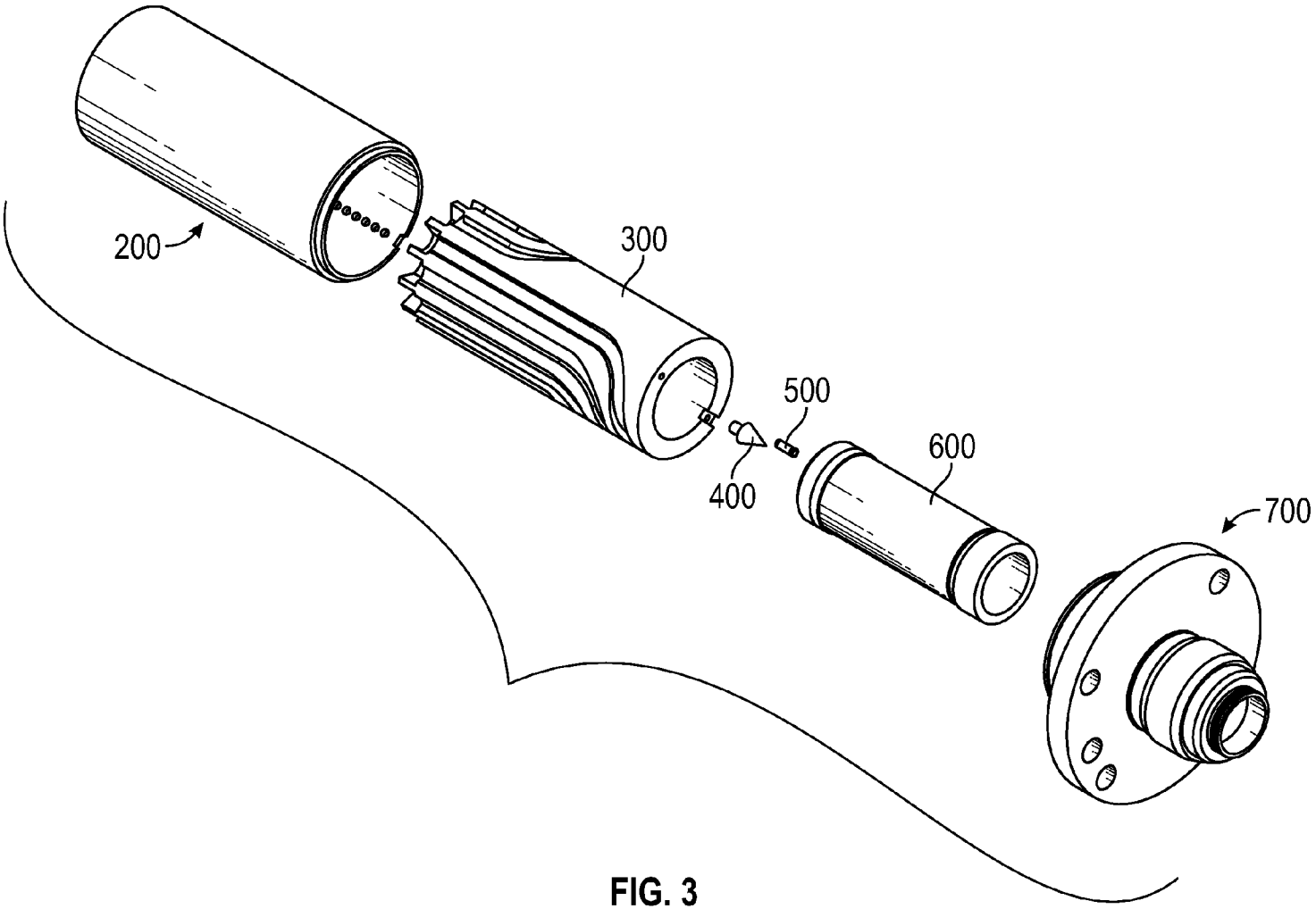
FIG. 3 is an exploded isometric view of the channel guide distributor, according to an embodiment of the present disclosure.

Referring now to FIGS. 2 and 3. FIG. 2 illustrates an isometric view of a channel guide distributor 100, according to an embodiment of the present disclosure. FIG. 3 illustrates an exploded isometric view of the channel guide distributor 100, according to an embodiment of the present disclosure. In the illustrated embodiment, the channel guide distributor 100 of a heat exchanger is composed of a flanged body 700, a nozzle 500 fluidly connected to the flanged body 700, a diffuser 300 fluidly connected to the nozzle 600, a pin 500 operably connected to the nozzle 600, a cone 400 operably connected to the nozzle 600, and a post 200 removably connected to the flange 700 and configured to receive the diffuser 300.

Advantageously, channel guide distributor 100 will help maintain the homogeneity and help deliver the liquid/gas mixture equally to each layer in an evaporator of heat exchanger. The channel guide distributor 100 will provide more uniform distribution to the evaporator passages of the heat exchanger resulting in improved heat exchanger performance over a wide range of flow conditions. As a result, the air-conditioning/refrigeration unit will exhibit an increase in its coefficient of performance, reduced power consumption, and smaller/lighter evaporator than would otherwise be required.

Figure 4:
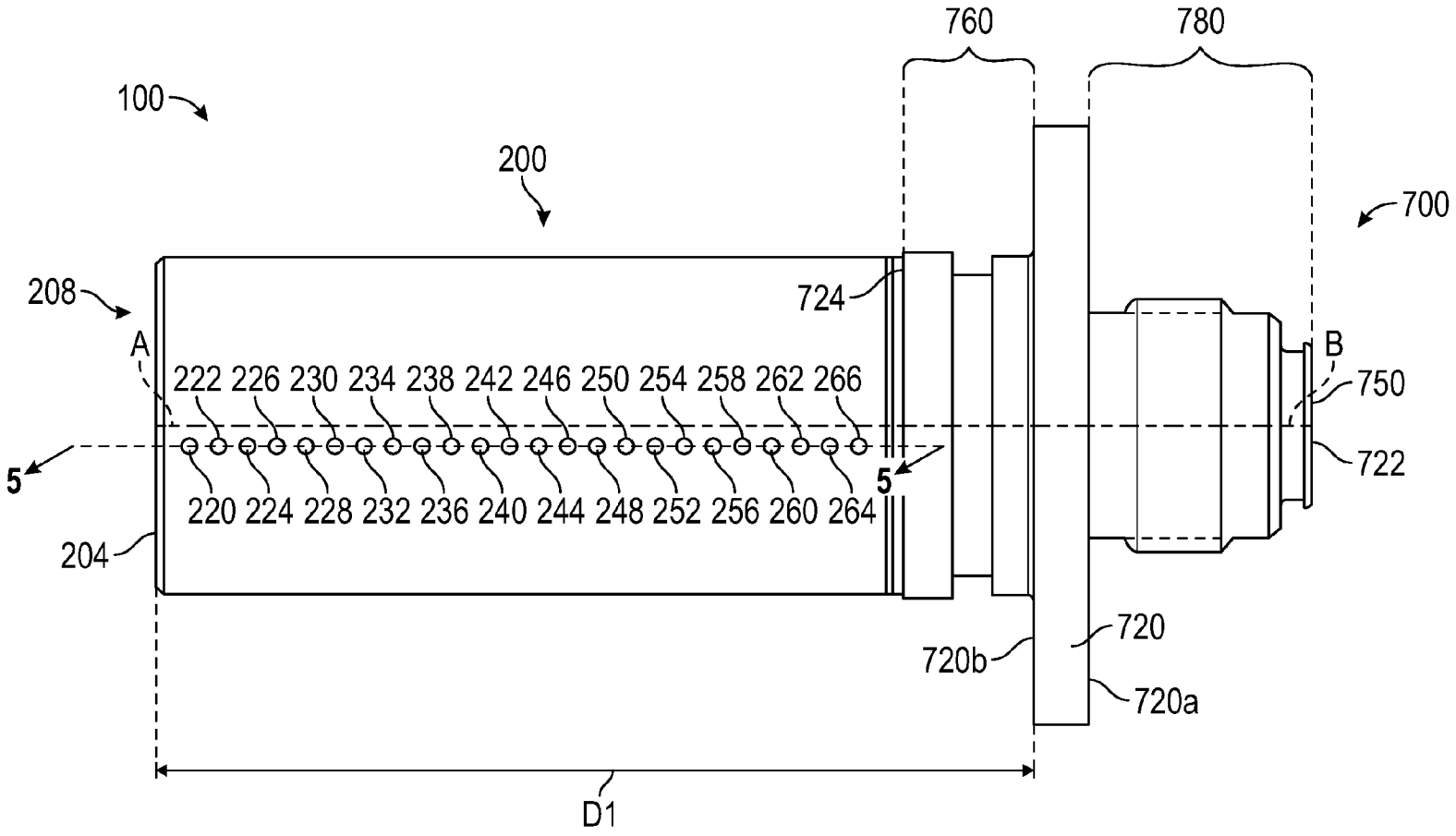
FIG. 4 is a side view of the channel guide distributor, according to an embodiment of the present disclosure.
Figure 5:
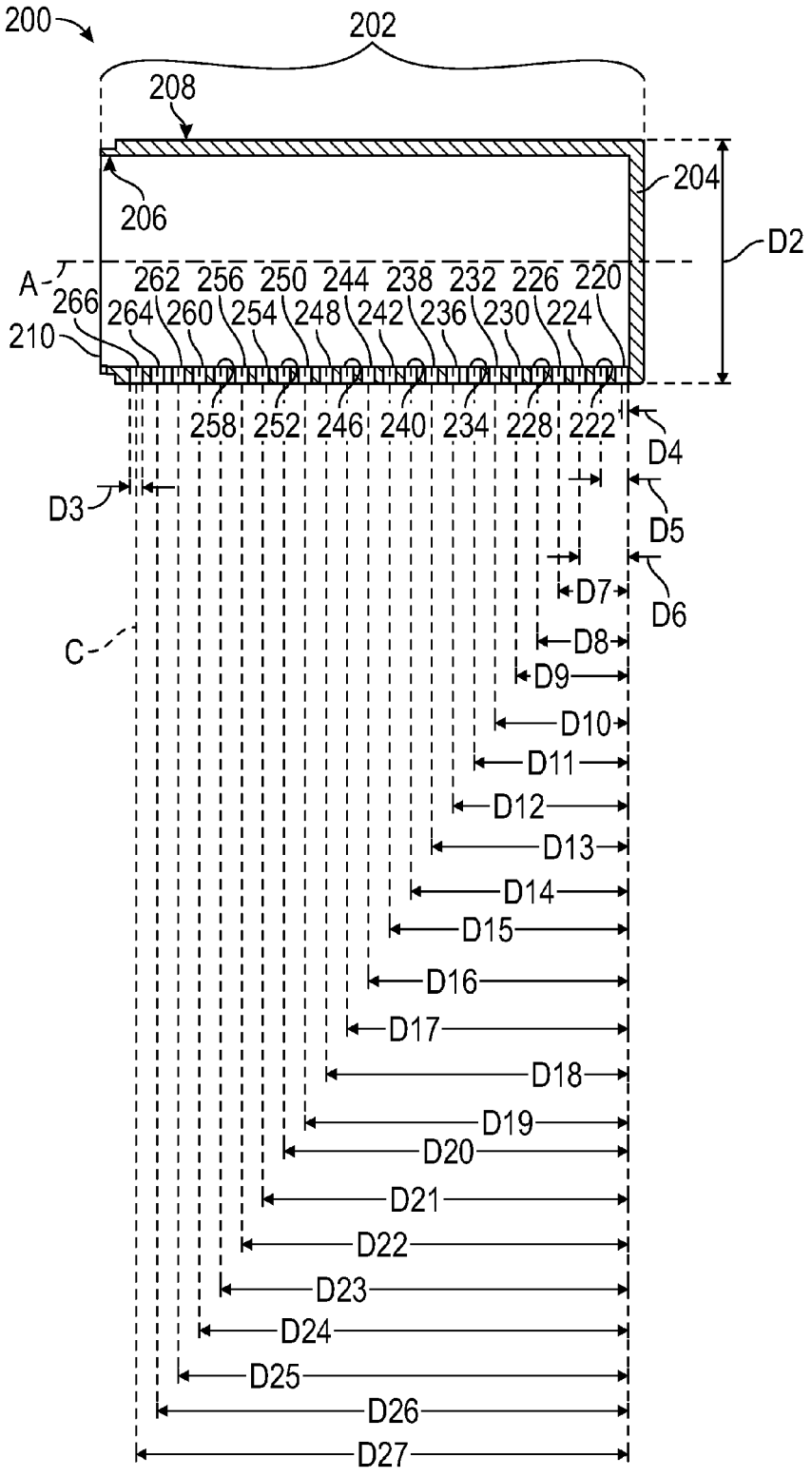
FIG. 5 is a cross-sectional view of a post of the channel guide distributor, according to an embodiment of the present disclosure.

Referring now to FIGS. 4 and 5. FIG. 4 illustrates a side view of the channel guide distributor 100, according to an embodiment of the present disclosure is illustrated. FIG. 5 illustrates a cross-sectional view of a post 200 of the channel guide distributor 100, according to an embodiment of the present disclosure. In the illustrated embodiment, the post 200 includes a tubular portion 202, an open end 210, a closed end 204, an inner surface 206, an outer surface 208, a post longitudinal axis A, and twenty-four apertures (e.g., 220, 222, 224, 226, 228, 230, 232, 234, 236, 238, 240, 242, 244, 246, 248, 250, 252, 256, 258, 260, 262, 264, and 266) in the tubular portion 202. The apertures are aligned linearly along the post longitudinal axis A and equidistantly spaced. The diameter D2 of the outer surface 208 of the tubular portion 202 is about 1.156±0.003 inches (2.936±0.01 centimeters). The apertures each have a diameter D3 of about 0.055 inches (0.14 centimeters). The apertures are equidistantly spaced at a distance of about 0.1 inches (0.254 centimeters), as measured along the post longitudinal axis A from a center point C of each aperture.

A distance D4 between a center point C of a first aperture 220 and the inner surface 206 of the closed end 204 is about 0.032 inches (0.081 centimeters), as measured along the post longitudinal axis A. As visible in both FIGS. 4 and 5, the first aperture 220 is the closest aperture to the inner surface 206 of closed end 204. A distance D5 between a center point C of a second aperture 222 and the inner surface 206 of the closed end 204 is about 0.132 inches (0.335 centimeters), as measured along the post longitudinal axis A. A distance D6 between a center point C of a third aperture 224 and the inner surface 206 of the closed end 204 is about 0.232 inches (0.589 centimeters), as measured along the post longitudinal axis A. A distance D7 between a center point C of a fourth aperture 226 and the inner surface 206 of the closed end 204 is about 0.332 inches (0.843 centimeters), as measured along the post longitudinal axis A. A distance D8 between a center point C of a fifth aperture 228 and the inner surface 206 of the closed end 204 is about 0.432 inches (1.097 centimeters), as measured along the post longitudinal axis A.

A distance D9 between a center point C of a sixth aperture 230 and the inner surface 206 of the closed end 204 is about 0.532 inches (1.351 centimeters), as measured along the post longitudinal axis A. A distance D10 between a center point C of a seventh aperture 232 and the inner surface 206 of the closed end 204 is about 0.632 inches (1.605 centimeters), as measured along the post longitudinal axis A. A distance D11 between a center point C of a eighth aperture 234 and the inner surface 206 of the closed end 204 is about 0.732 inches (1.859 centimeters), as measured along the post longitudinal axis A. A distance D12 between a center point C of an ninth aperture 236 and the inner surface 206 of the closed end 204 is about 0.832 inches (2.113 centimeters), as measured along the post longitudinal axis A. A distance D13 between a center point C of a tenth aperture 238 and the inner surface 206 of the closed end 204 is about 0.932 inches (2.367 centimeters), as measured along the post longitudinal axis A. A distance D14 between a center point C of a eleventh aperture 240 and the inner surface 206 of the closed end 204 is about 1.032 inches (2.621 centimeters), as measured along the post longitudinal axis A.

A distance D15 between a center point C of an twelfth aperture 242 and the inner surface 206 of the closed end 204 is about 1.132 inches (2.875 centimeters), as measured along the post longitudinal axis A. A distance D16 between a center point C of a thirteenth aperture 244 and the inner surface 206 of the closed end 204 is about 1.232 inches (3.129 centimeters), as measured along the post longitudinal axis A. A distance D17 between a center point C of a fourteenth aperture 246 and the inner surface 206 of the closed end 204 is about 1.332 inches (3.383 centimeters), as measured along the post longitudinal axis A. A distance D18 between a center point C of a fifteenth aperture 248 and the inner surface 206 of the closed end 204 is about 1.432 inches (3.637 centimeters), as measured along the post longitudinal axis A.

A distance D19 between a center point C of a sixteenth aperture 250 and the inner surface 206 of the closed end 204 is about 1.532 inches (3.891 centimeters), as measured along the post longitudinal axis A. A distance D20 between a center point C of a seventeenth aperture 252 and the inner surface 206 of the closed end 204 is about 1.632 inches (4.145 centimeters), as measured along the post longitudinal axis A. A distance D21 between a center point C of a eighteenth aperture 254 and the inner surface 206 of the closed end 204 is about 1.732 inches (4.399 centimeters), as measured along the post longitudinal axis A. A distance D22 between a center point C of an nineteenth aperture 256 and the inner surface 206 of the closed end 204 is about 1.832 inches (4.653 centimeters), as measured along the post longitudinal axis A.

A distance D23 between a center point C of a twentieth aperture 258 and the inner surface 206 of the closed end 204 is about 1.932 inches (4.907 centimeters), as measured along the post longitudinal axis A. A distance D24 between a center point C of a twenty-first aperture 260 and the inner surface 206 of the closed end 204 is about 2.032 inches (5.161 centimeters), as measured along the post longitudinal axis A. A distance D25 between a center point C of a twenty-second aperture 262 and the inner surface 206 of the closed end 204 is about 2.132 inches (5.415 centimeters), as measured along the post longitudinal axis A. A distance D26 between a center point C of a twenty-third aperture 264 and the inner surface 206 of the closed end 204 is about 2.232 inches (5.669 centimeters), as measured along the post longitudinal axis A. A distance D27 between a center point C of a twenty-fourth aperture 266 and the inner surface 206 of the closed end 204 is about 2.332 inches (5.923 centimeters), as measured along the post longitudinal axis A.

The flanged body 700 includes an inlet 722, an outlet 724, a first section 780 proximate the inlet 722, a second section 760 proximate the outlet 724, a flange 720 between the first section 780 and the second section 760, a flange longitudinal axis B and an orifice 750 connecting the outlet 724 to the inlet 722. The flange 720 has a first surface proximate 720*a* to the first section 780 and a second surface 720*b* proximate to the second section 760. As seen in FIG. 4, the distance D1 between the outer surface 208 of the closed end 204 of the post 200 and the second surface 720*b* of the flange 720 is about 2.99±0.015 inches (7.595±0.04 centimeters), as measured along the post longitudinal axis A. The post longitudinal axis A and the flange longitudinal axis B are co-linear.

Figure 6:
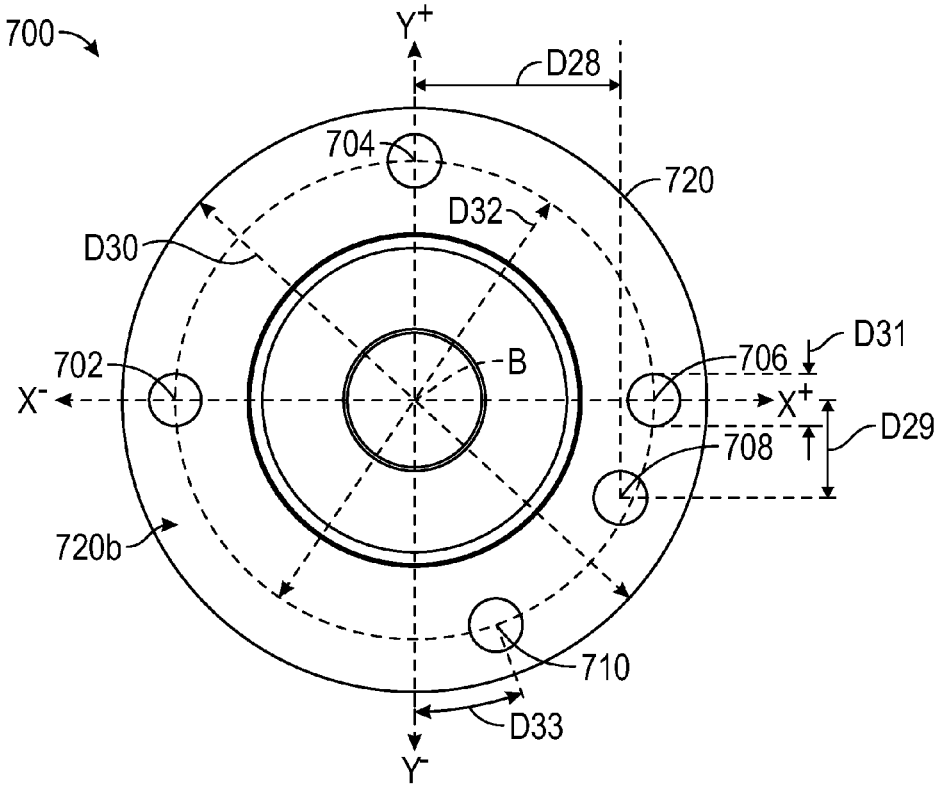
FIG. 6 is an axial view of a flanged body of the channel guide distributor, according to an embodiment of the present disclosure.

Referring now to FIG. 6. FIG. 6 illustrates an axial view of a flanged body 700 of the channel guide distributor 100, according to an embodiment of the present disclosure. In the illustrated embodiment, the flange 720 of the flanged body 700 further includes four holes (e.g., 702, 704, 706, and 710) perpendicular to planes formed by the first surface 720*a* and the second surface 720*b*. The four holes have a diameter D31 of about 0.188±0.004 inches (0.478±0.01 centimeters) and spaced circumferentially around the flange longitudinal axis B at a diameter D32 of about 1.690±0.01 inches (4.293±0.03 centimeters). In the illustrated embodiment, a second hole 704 is located 90° circumferentially away from a first hole 702. Additionally, a third hole 706 is located 90° circumferentially away from the second hole 704 and 180° circumferentially away from the first hole 702. A fourth hole 710 is located (90°—D33) circumferentially away from the third hole 706, (180°—D33) circumferentially away from the second hole 704, and (270°—D33) circumferentially away from the first hole 702. The angle D33 is about 20°±5°. In the illustrated embodiment, the flange 720 includes a fifth hole 708. In FIG. 6, axis X and axis Y may be used to help locate the fifth hole 708 (e.g. $X^+$ is in the positive X direction, $X^-$ is in the negative X direction; $Y^+$ is in the positive Y direction, $Y^-$ is in the negative Y direction). The fifth hole 708 is located at a cartesian location (X,Y), (D28, −D29) wherein distance D28 is about 0.724±0.01 inches (1.839±0.03 centimeters) and distance D29 is about 0.345±0.01 inches (0.876±0.03 centimeters). The fifth hole 708 has a diameter D31 of about 0.188±0.004 inches (0.478±0.01 centimeters).

Figure 7:
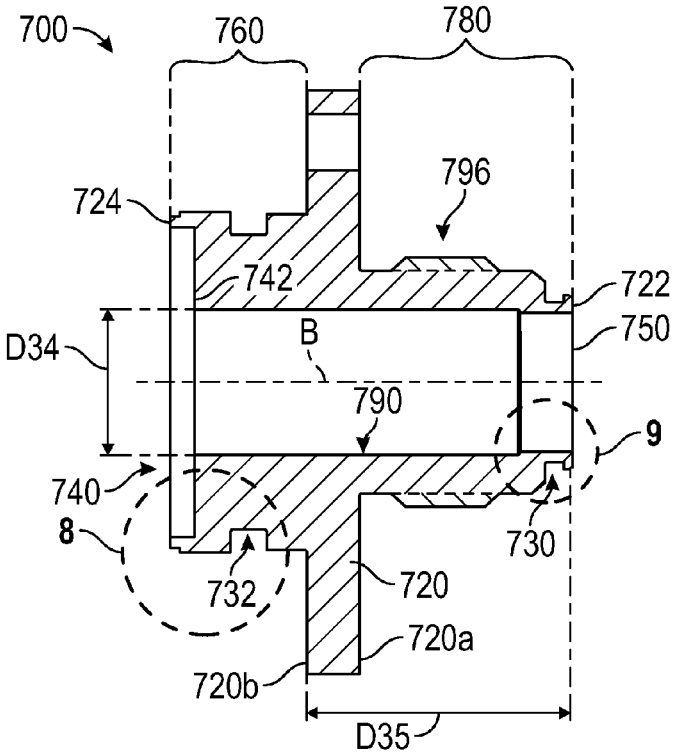
FIG. 7 is a cross-sectional side view of a flanged body of the channel guide distributor, according to an embodiment of the present disclosure.
Figure 8:
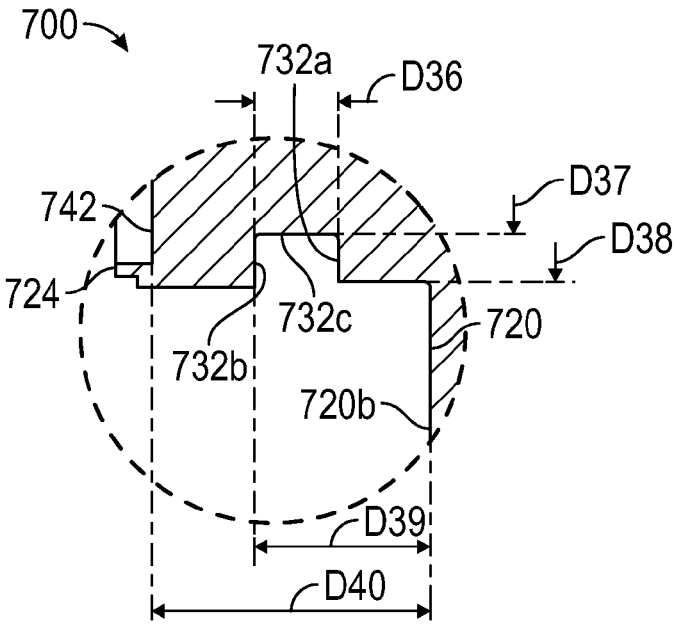
FIG. 8 is a magnified side view of the flanged body of the channel guide distributor, according to an embodiment of the present disclosure.
Figure 9:
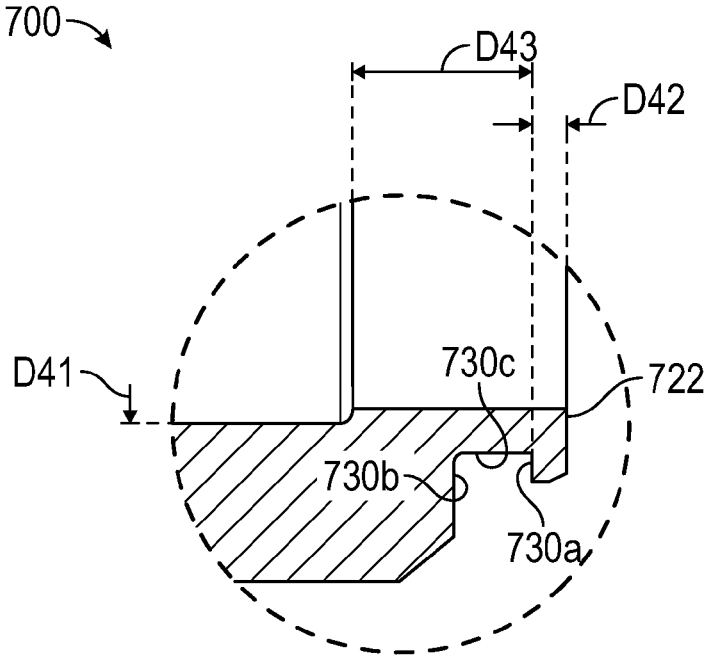
FIG. 9 is a magnified side view of the flanged body of the channel guide distributor, according to an embodiment of the present disclosure.

Referring now to FIGS. 7-9. FIG. 7 illustrates a cross-sectional side view of a flanged body 700 of the channel guide distributor 100, according to an embodiment of the present disclosure. FIG. 8 illustrates a magnified side view of the flanged body 700 of the channel guide distributor 100, according to an embodiment of the present disclosure. FIG. 9 illustrates a magnified side view of the flanged body 700 of the channel guide distributor 100, according to an embodiment of the present disclosure.

In the illustrated embodiment, the flanged body 700 has an interior surface 790 and an exterior surface 796. The exterior surface 796 of the flanged body 700 at the second section 760 has a diameter D38 of 1.1735±0.0005 inches (2.9807±0.0013 centimeters). The exterior surface 796 of the flanged body 700 at the flange 720 has a diameter D30 of about 2.060±0.01 inches (5.232±0.03 centimeters). The orifice 750 has a diameter D34 of about 0.500 inches (1.270 centimeters). A distance D35 between the second surface 720*b* of the flange 720 and the inlet 722 is about 0.960±0.005 inches (2.438±0.01 centimeters), as measured along the flange longitudinal axis B. As seen in FIG. 7, the flanged body 700 includes a counter bore 740 at the outlet 724 of the flanged body 700. A distance D40 between the base 742 of the counter bore 740 and the second surface of the flange 720*b* is about 0.395±0.005 inches (1.003±0.01 centimeters). This counter bore 740 may be used as a mating surface for removable connections with objects such as for example, a post 200 pictured in FIG. 5.

The first section 780 of the flanged body 700 further includes a first recess 730 in the exterior surface 796 of the flanged body 700. The first recess 730 has a first edge 730*a*, a base 730*c* and a second edge 730*b*, wherein the first edge 730*a* of the first recess 730 is located at a distance D42 of about 0.028±0.004 inches (0.071±0.01 centimeters) away from the inlet 722. The first recess 730 has a width D43 of about 0.076±0.002 inches (0.193±0.01 centimeters). The diameter D41 of the exterior surface 796 at the base 730*c* of the first recess 730 is about 0.516±0.002 inches (1.311±0.01 centimeters). The first recess 730 may be used as a sealing surface.

The second section 760 of the flanged body 700 further includes a second recess 732 in the exterior surface 796 of the flanged body 700, the second recess 732 having a first edge 732*a*, a base 732*c* and a second edge 732*b*, wherein the second edge 732*b* of the second recess 732 is located at a distance D39 of about 0.275±0.005 inches (0.699±0.01 centimeters) away from the second surface 720*b* of the flange 720. The second recess 732 has a width D36 of about 0.138±0.003 inches (0.351±0.01 centimeters). The diameter D37 of the exterior surface 796 at the base 732*c* of the second recess 732 is about 1.023±0.001 inches (2.598±0.003 centimeters). The second recess 732 may be used as a sealing surface.

The term "about" is intended to include the degree of error associated with measurement of the particular quantity based upon the equipment available at the time of filing the application. For example, "about" can include a range of ±8% or 5%, or 2% of a given value.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A channel guide distributor of a heat exchanger comprising:

a flanged body;

a nozzle fluidly connected to the flanged body;

a diffuser fluidly connected to the nozzle;

a pin operably connected to the nozzle;

a cone operably connected to the nozzle; and a post removably connected to the flanged body and configured to receive the diffuser, the post having a tubular portion, an open end, a closed end, an inner surface, an outer surface, a post longitudinal axis, and twenty-four apertures in the tubular portion, wherein the apertures are aligned linearly along the post longitudinal axis and equidistantly spaced, wherein a diameter of the outer surface of the tubular portion is about 1.156±0.003 inches (2.936±0.01 centimeters).

2. The channel guide distributor according to claim 1, wherein:

the apertures each have a diameter of about 0.055 inches (0.14 centimeters).

3. The channel guide distributor according to claim 2, wherein:

the apertures are equidistantly spaced at a distance of about 0.1 inches (0.254 centimeters), as measured along the post longitudinal axis from a center point of each aperture.

4. The channel guide distributor according to claim 3, wherein:

a distance between a center point of a first aperture and the inner surface of the closed end is about 0.032 inches (0.081 centimeters), wherein the first aperture is the closest aperture to the inner surface of closed end.

5. The channel guide distributor according to claim 4, wherein the flanged body further includes:

an inlet, an outlet, an interior surface, an exterior surface, a first section proximate the inlet, a second section proximate the outlet, a flange between the first section and the second section, a flange longitudinal axis, and an orifice connecting the outlet to the inlet, wherein the exterior surface of the flanged body at the second section has a diameter of 1.1735±0.0005 inches (2.9807±0.0013 centimeters), wherein the flange has a first surface proximate to the first section and a second surface proximate to the second section, wherein the orifice has a diameter of about 0.500 inches (1.270 centimeters), wherein a distance between the second surface of the flange and the inlet is about 0.960±0.005 inches (2.438±0.01 centimeters), as measured along the flange longitudinal axis.

6. The channel guide distributor according to claim 5, wherein:

a distance between the outer surface of the closed end of the post and the second surface of the flange is about 2.99±0.015 inches (7.595±0.04 centimeters), as measured along the post longitudinal axis.

7. The channel guide distributor according to claim 6, wherein:

the exterior surface at the flange has a diameter of about 2.060±0.01 inches (5.232±0.03 centimeters).

8. The channel guide distributor according to claim 7, wherein the first section of the flanged body further includes:

a first recess in the exterior surface of the flanged body, the first recess having a first edge, a base and a second edge, wherein the first edge of the first recess is located at a distance of about 0.028±0.004 inches (0.071±0.01 centimeters) away from the inlet, wherein the first recess has a width of about 0.076±0.002 inches (0.193±0.01 centimeters), wherein a diameter of the exterior surface at the base of the first recess is about 0.516±0.002 inches (1.311±0.01 centimeters).

9. The channel guide distributor according to claim 8, wherein the second section of the flanged body further includes:

a second recess in the exterior surface of the flanged body, the second recess having a first edge, a base and a second edge, wherein the second edge of the second recess is located at a distance of about 0.275±0.005 inches (0.699±0.01 centimeters) away from the second surface of the flange, wherein the second recess has a width of about 0.138±0.003 inches (0.351±0.01 centimeters), wherein a diameter of the exterior surface at the base of the second recess is about 1.023±0.001 inches (2.598±0.003 centimeters).

10. The channel guide distributor according to claim 9, wherein the flange of the flanged body further includes:

four holes perpendicular to the planes formed by the first surface and the second surface, the holes having a diameter of about 0.188±0.004 inches (0.478±0.01 centimeters) and spaced circumferentially around the flange longitudinal axis at a diameter of about 1.690±0.01 inches (4.293±0.03 centimeters).

11. A channel guide distributor of a heat exchanger comprising a flanged body having an inlet, an outlet, an interior surface, an exterior surface, a first section proximate the inlet, a second section proximate the outlet, a flange between the first section and the second section, a flange longitudinal axis, and an orifice connecting the outlet to the inlet, wherein the exterior surface of the flanged body at the second section has a diameter of 1.1735±0.0005 inches (2.9807±0.0013 centimeters), wherein the flange has a first surface proximate to the first section and a second surface proximate to the second section, wherein the orifice has a diameter of about 0.500 inches (1.270 centimeters), wherein a distance between the second surface of the flange and the inlet is about 0.960±0.005 inches (2.438±0.01 centimeters), as measured along the flange longitudinal axis;

a nozzle fluidly connected to the flanged body;

a diffuser fluidly connected to the nozzle;

a pin operably connected to the nozzle;

a cone operably connected to the nozzle; and a post removably connected to the flanged body and configured to receive the diffuser.

12. The channel guide distributor according to claim 11, wherein:

the exterior surface at the flange has a diameter of about 2.060±0.01 inches (5.232±0.03 centimeters).

13. The channel guide distributor according to claim 12, wherein the first section of the flanged body further includes:

a first recess in the exterior surface of the flanged body, the first recess having a first edge, a base and a second edge, wherein the first edge of the first recess is located at a distance of about 0.028±0.004 inches (0.071±0.01 centimeters) away from the inlet, wherein the first recess has a width of about 0.076±0.002 inches (0.193±0.01 centimeters), wherein a diameter of the exterior surface at the base of the first recess is about 0.516±0.002 inches (1.311±0.01 centimeters).

14. The channel guide distributor according to claim 13, wherein the second section of the flanged body further includes:

a second recess in the exterior surface of the flanged body, the second recess having a first edge, a base and a second edge, wherein the second edge of the second recess is located at a distance of about 0.275±0.005 inches (0.699±0.01 centimeters) away from the second surface of the flange, wherein the second recess has a width of about 0.138±0.003 inches (0.351±0.01 centimeters), wherein a diameter of the exterior surface at the base of the second recess is about 1.023±0.001 inches (2.598±0.003 centimeters).

15. The channel guide distributor according to claim 14, wherein the flange of the flanged body further includes:

four holes perpendicular to the planes formed by the first surface and the second surface, the holes having a diameter of about 0.188±0.004 inches (0.478±0.01 centimeters) and spaced circumferentially around the flange longitudinal axis at a diameter of about 1.690±0.01 inches (4.293±0.03 centimeters).

16. The channel guide distributor according to claim 15, wherein the post further includes:

the post having a tubular portion, an open end, a closed end, an inner surface, an outer surface, a post longitudinal axis, and twenty-four apertures in the tubular portion, wherein the apertures are aligned linearly along the post longitudinal axis and equidistantly spaced, wherein a diameter of the outer surface of the tubular portion is about 1.156±0.003 inches (2.936±0.01 centimeters).

17. The channel guide distributor according to claim 16, wherein:

a distance between the outer surface of the closed end of the post and the second surface of the flange is about 2.99±0.015 inches (7.595±0.04 centimeters), as measured along the post longitudinal axis.

18. The channel guide distributor according to claim 17, wherein:

the apertures each have a diameter of about 0.055 inches (0.14 centimeters).

19. The channel guide distributor according to claim 18, wherein:

the apertures are equidistantly spaced at a distance of about 0.1 inches (0.254 centimeters), as measured along the post longitudinal axis from a center point of each aperture.

20. The channel guide distributor according to claim 19, wherein:

a distance between a center point of a first aperture and the inner surface of the closed end is about 0.032 inches (0.081 centimeters), wherein the first aperture is the closest aperture to the inner surface of closed end.

* * * * *